US005938098A

United States Patent [19]

Fife

[11] Patent Number: 5,938,098

[45] Date of Patent: Aug. 17, 1999

[54] SERVO VALVE

[76] Inventor: Robert L. Fife, P.O. Box 136084, Fort Worth, Tex. 76136-0084

[21] Appl. No.: 09/193,568

[22] Filed: Nov. 17, 1998

[51] Int. Cl.[6] ..... B65H 43/00; F17D 31/128

[52] U.S. Cl. ..... 226/19; 226/22; 242/563.1; 137/625.18; 137/595; 251/61.2

[58] Field of Search ..... 226/19, 22; 242/563.1; 251/61, 61.1, 61.2, 61.3; 137/625.18, 595

[56] References Cited

U.S. PATENT DOCUMENTS

| | | | |
|---|---|---|---|
| 1,615,415 | 1/1927 | Tandel . | |
| 2,814,487 | 11/1957 | Medkeff . | |
| 3,071,157 | 1/1963 | Robertson et al. | 226/22 X |
| 3,098,595 | 7/1963 | Shelton | 226/22 |
| 3,244,340 | 4/1966 | Fife et al. | 226/22 |
| 3,310,942 | 3/1967 | Stanford . | |
| 3,563,484 | 2/1971 | Bray, Jr. | 226/22 X |
| 3,599,849 | 8/1971 | Callan | 226/22 |
| 3,693,855 | 9/1972 | Bonner | 226/19 |
| 3,727,817 | 4/1973 | Tibavido . | |
| 3,908,881 | 9/1975 | McCann . | |
| 4,054,251 | 10/1977 | Henderson et al. . | |
| 4,073,448 | 2/1978 | Kolosov . | |
| 4,609,012 | 9/1986 | Shelton . | |
| 4,655,378 | 4/1987 | DuFour . | |
| 5,664,738 | 9/1997 | Fife . | |

*Primary Examiner*—Michael R. Mansen
*Attorney, Agent, or Firm*—Geoffrey A. Mantooth

[57] ABSTRACT

A positive pressure operated servo apparatus for lateral alignment of a continuous web of paper, plastic, textiles and other materials which are being processed at windup, unwind, printing, coating, folding and slitting stations, or other intermediate points in the machine process. The apparatus includes an air source communicating with a sensor and servo valve which regulates a double-acting air actuator having an output member to move a web positioning assembly. The servo valve is regulated by a diaphragm that is controlled by a pneumatic correction signal force from a low pressure sensor circuit and is arranged under the influence of such signal force to selectively position a valve element relative to two orifice openings to provide differential air pressure proportional to error to operate the actuator to produce actuator movement proportional to the error to correct and maintain the position of the web.

9 Claims, 4 Drawing Sheets

SERVO VALVE

BACKGROUND OF THE INVENTION

This invention relates to new and useful improvements in pneumatic servo valves used with automatic web guiding systems.

Automatic web guiding systems are used to control the lateral position of moving webs of material, such as paper, plastics, textiles and other flexible materials being processed in continuous or roll form. A signal is generated by the position of the web edge relative to a sensor, and the signal output either directly controls an actuator connected to positioning means or indirectly controls an actuator through a servo valve which is connected to a web positioner. Positioners maintain the edge of the web at a desired location.

Various types of mechanical servo valves have been incorporated into automatic web guiding systems to control the operation of actuator means. As shown in U.S. Pat. No. 5,664,738 utilizes a pneumatic system having a feeler type sensor that rides on the web edge and incorporates a rotary valve that opens and closes over two matching orifices, limitations of this valve are due to the "feeler" being restricted to use on light plastic films and flimsy webs because of its mass. U.S. Pat. No. 4,609,012 is another pneumatic system having a moving suspension valve with two matching recesses that are spaced above a stationary block providing four way portage for proportional pneumatic flow for controlling actuator means. Due to the design of this valve it is limited in velocity and force, and uses excessive air. as well as being costly to manufacture and assemble. Both pneumatic systems are used in conjunction with double acting actuators.

The idea of spool type servo valves is not new or unique to automatic web guiding. Systems have incorporated four way hydraulic valves, providing proportional flow across the valve to a double acting actuator means. This system usually incorporates a low pressure, non contact pneumatic sensor which is highly desirable for sensing thin, delicate webs, that would resist direct contact from "feeler" type sensor.

Most all-pneumatic systems have not used spool type servo valves due to air loss across valve and lack of ability to achieve proportional stable control and web guiding accuracy. Air tight sealing would be needed to achieve control force at the actuator, which would create excessive friction by the sliding spool assembly, resulting in sticking or inability to generate adequate signal force, system stability and accuracy would be jeopardized, as well as excessive air usage.

SUMMARY OF THE INVENTION

According to the invention and forming a primary objective thereof, a low friction servo valve is provided with spool lands that close-off air flow over two exhaust orifices, as one orifice is opened to allow air to exhaust, the other is closed to provide pressure to one side of a double acting actuator, this procedure is reversed to allow force to the opposite side of actuator means. This improved use of air flow makes this valve highly responsive as to velocity and force output, as well as control accuracy and minimal air consumption.

Another object of the invention is to provide a valve of the type described that is capable of precise and accurate manufacture that is low cost and easily assembled and maintained.

Another objective of the invention is to incorporate a non-contact low positive air flow sensor which generates a signal force from lateral web movement as edge regulates air recovery across two opposing orifices. This non contact sensor is highly desirable for use with webs that are flimsy, such as plastic films and textiles, as well as a variety of relative stiff webs.

Another objective of the invention is to supply a spool valve that has lands that are slightly spaced from walls of the valve body to eliminate friction, as well as using low coefficient of friction bearings as support journals for reducing friction and holding valve alignment. This carefully constructed valve should not be subject to sticking. Valve is spring loaded from each end to allow biasing so that signals received from the sensor equalizes cylinder shifting speed. The exhaust orifices are sized and shaped to provide guiding accuracy and good system response.

Another objective of the invention is to provide a needle valve to adjust air supply force to the sensor to either increase or decrease velocity of signal to diaphragm means.

Another objective of the invention is to have two matching orifices in the air pressure supply force to reduce air usage and give good efficient operation of air supply.

Another objective of the invention is to adjust supply air pressure to increase or decrease actuator velocity and control force.

Another optional objective of the invention is to supply air pressure independently, through use of two independent air supplies, to sensor or diaphragm side of servo valve and control or actuator side. This allows an increase in control force to actuator means without effecting the signal force.

The purpose of this invention are accomplished by utilizing an air pressure source, such as a compressor, which is connected to a double acting, pneumatic actuator engaged to laterally move either the unwind or rewinding rolls or intermediate web positioning guide roller equipment in response to signal pressure changes. The signal force from the sensor is impinged directly upon a neoprene diaphragm which pilots a spool flow valve that is enclosed in a housing that has a pair of matching orifices facing the inner surfaces of two lands of the valve spool. As valve is opened to exhaust air from one orifice, second orifice is closed to supply control force to one side of a double acting cylinder. As signal force from sensor is reversed control valve reverses over the two valve exhaust orifices, opening the closed exhaust orifice and closing the other to control power to the actuator means. When both exhaust orifices are closed simultaneous, system is in a null position with no cylinder movement in either direction. This occurs when web is on track and no lateral movement is detected at sensor.

The invention will be better understood and additional objectives and advantages will become apparent from the following description taken in conjunction with the accompanying drawings.

DETAILED DESCRIPTION OF DRAWINGS

Figure 1:
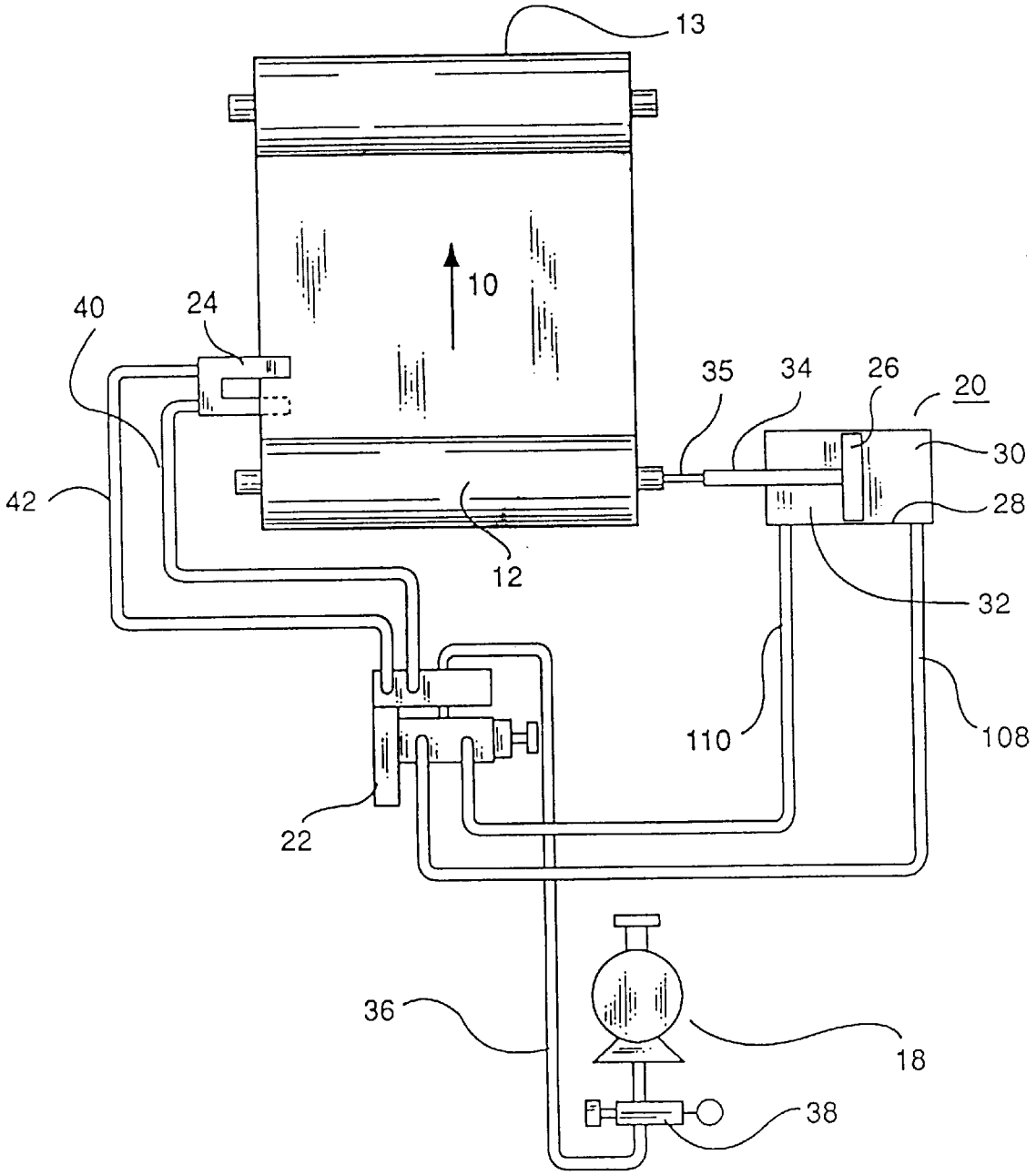
FIG. 1 is a diagrammatic view of a controlled system embodying the present invention.

Referring to FIG. 1, the apparatus of the pneumatic web guide system of the present invention is used in association with a moving web indicated generally at 10. Such a web may be in the form of paper, tape, cloth, foil plastics or other flexible materials. By way of example, the web 10 may move longitudinally between a supply roll 12 and a take up roll 13. During such movement, the web may shift laterally because of misalignment of the material wound on the roll 12. Such misalignment of the web 10 can be adjusted or corrected by shifting the supply roll 12 laterally in proportion to the sensed misalignment. This forms the guide means for correcting the path of the web 10. Also, the lateral position of web can be corrected at intermediate points of the moving web by changing the angular position of a guide roller (not shown) in contact with the web 10. Such guide rollers form parts of web guide arrangements for maintaining webs in a predetermined path and are available commercially in many forms.

The lateral position of the web 10 is controlled automatically by a web control system. The principle components of which are an air compressor 18 for a continuous supply of compressed air, a double acting actuator 20 operatively connected to supply roll 12 to move it axially and a servo valve assembly 22 and sensor 24 which responds to the lateral position of the web 10 to control the operation of the actuator 20 to bring about corrective movement of the roll 12 and therefore the lateral position of web 10. The actuator 20 is of the double acting type and incorporates a moveable wall in the form of a piston 26 in a cylinder 28 and forming a pair of air pressure chambers 30 and 32 at opposite sides of the piston 26. The piston 26 is connected through a rod 34 to various linkages and mechanism indicated generally at 35 to bring about lateral movement of the supply roll 12. A variety of apparatus responsive to the movement of an actuator 20 is available to bring about such corrective movement of a supply roll 12. Similarly, actuator 20 can be used in association with rewind rolls or web guide mechanism at intermediate points of a web (not shown).

The output of the compressor 18 is supplied through a conduit 36 and through a pressure regulator 38, to port connector 84 on port plate 46, (see FIG. 2) of the servo valve assembly.

The sensor 24 is mounted in a fixed but adjustable position relative to the edge of the web 10. The sensor 24 is connected pneumatically through branch conduits 40 and 42 to the servo valve 22.

The embodiment of the servo valve comprises a sensor port plate 46, in turn connecting to actuator port plate 48 and diaphram housing 50 and 52 respectively. Actuator port plate 48 is secured to valve body 54 by screws 124.

Figure 2:
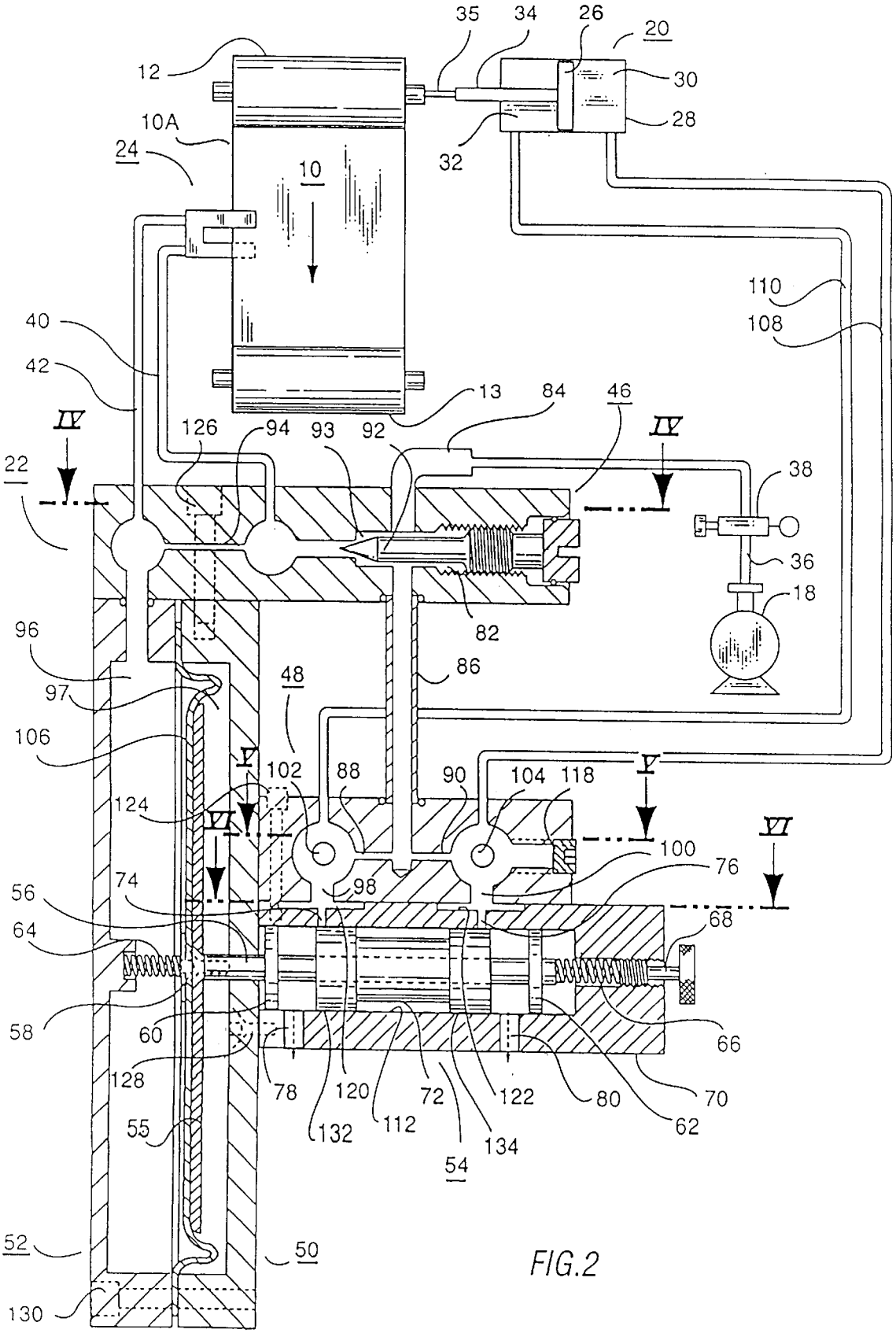
FIG. 2 is a schematic cross sectional view of the servo valve, in accordance with a preferred embodiment.
Figure 3:
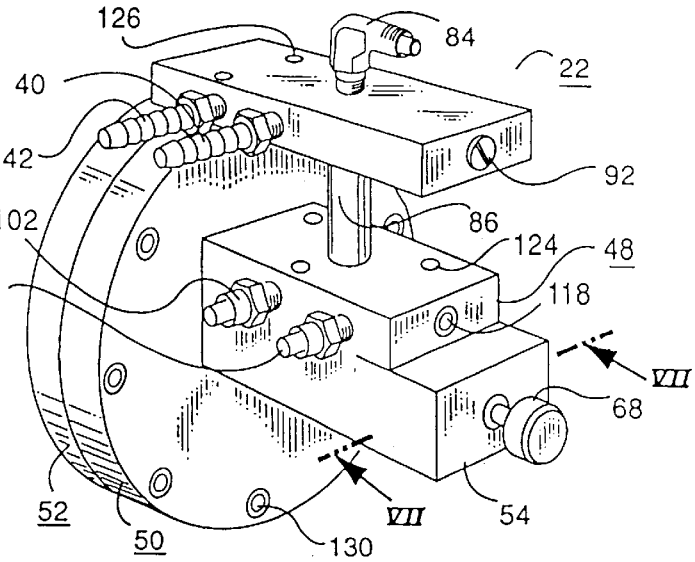
FIG. 3 is a perspective view showing the basic configuration of the servo valve.
Figure 4:
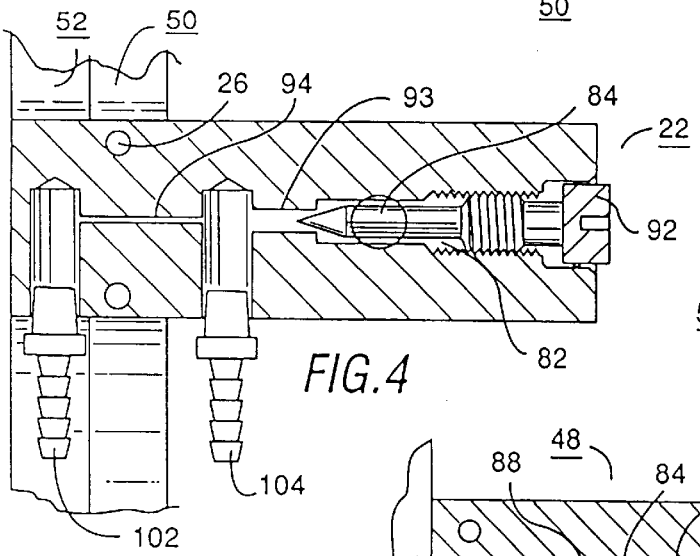
FIG. 4 is a cross-sectional view of the sensor port plate, taken along lines IV—IV of FIG. 2.
Figure 7:
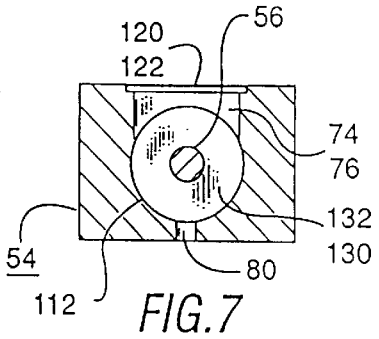
FIG. 7 is a cross-sectional view of the valve body, taken along lines VII—VII of FIG. 6.
Figure 5:
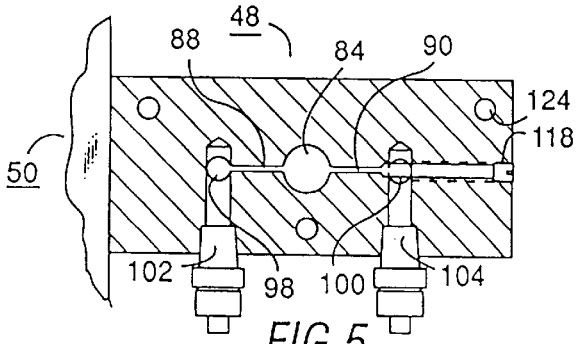
FIG. 5 is a cross-sectional view of the actuator port plate, taken along lines V—V of FIG. 2.
Figure 6:
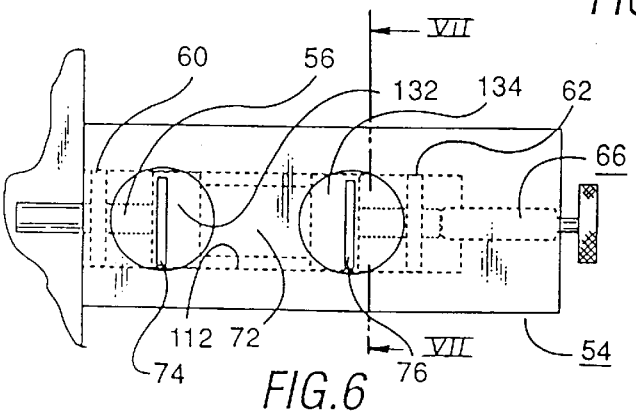
FIG. 6 is a plan view of the valve body, taken along lines VI—VI of FIG. 2.
Figure 8:
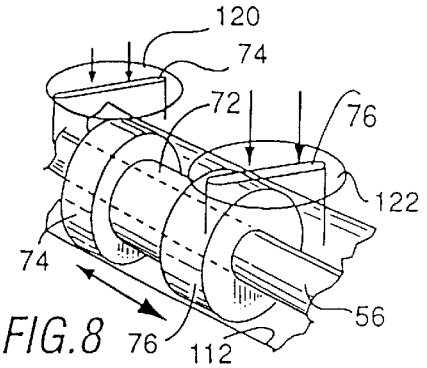
FIG. 8 is a perspective view of the spool end valve body.

Referring to FIG. 2, a housing 50 is secured to sensor port plate 46 and valve body 54 by screws 126 and 128 respectively, and a housing 52 is secured to the rear of housing 50 as by screws 130. These housings 50 and 52 connect to a portion of the sensor port plate 46 and have cooperating cavities 96 and 97 (FIG. 2) to form a diaphragm chamber enclosing a thin, flexible diaphragm 106 securely clamped between the upright housings. The diaphragm 106 has a reinforcing body portion 55 integral therewith. Body portion is connected to valve shaft 56 end by screw 58. Valve shaft ends extend through two low friction support bearings 60 and 62 which provide alignment and support. Each end of valve shaft 56 is spring engaged 64 and 66. Spring 66 is a biasing spring and is made variable in its force by an adjustment screw 68 in the front end plate 70. Front end plate 70 is coupled to valve body by screws. Valve shaft 56 supports spool 72, which is laterally adjustable, having spool lands 132 and 134 forming closures over matched and sized exhaust vent orifices 74 and 76. Normally, spool length is set to slightly close off both vent orifices. This spool length determines the accuracy or response of the system. The spool lands 132 and 134 extend slightly past exhaust orifice openings 74 and 76 to act as an air flow restriction at one orifice, as the other orifice is vented during operation through ports 78 or 80. A minute spacing exists between valve spool lands 132 and 134 and valve body 54, thus eliminating metal to metal contact and possible spool sticking. Two separate spools could be used and spaced apart over exhaust orifice openings 74 and 76, which could be adjusted to reduce control accuracy and system response. Spool movement is reversed when web edge direction is reversed at sensor 24.

Operation of the servo valve is accomplished by an air supply from a suitable compressor 18, through a conduit 36 to a pressure regulator 38, supplying a continuous supply of forced air to connecting port 84, in the sensor port plate 46 through passageway 82, which simultaneously supplies air to sensor 24 and actuator 20.

Figure 9:
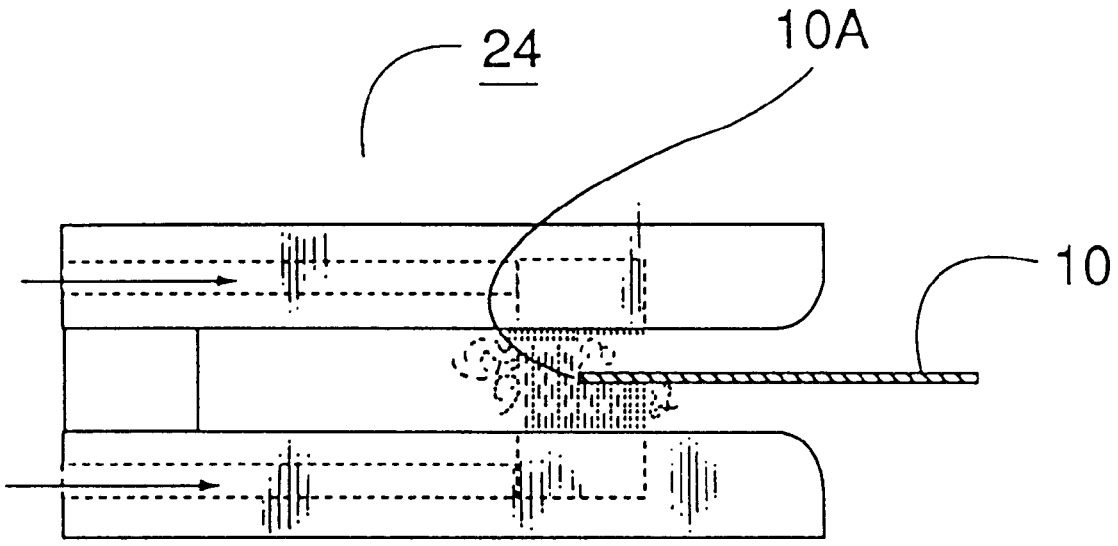
FIG. 9 is an elevation view of the sensor, as positioned along an edge of a web, illustrating the flow of air there along.
Figure 10:
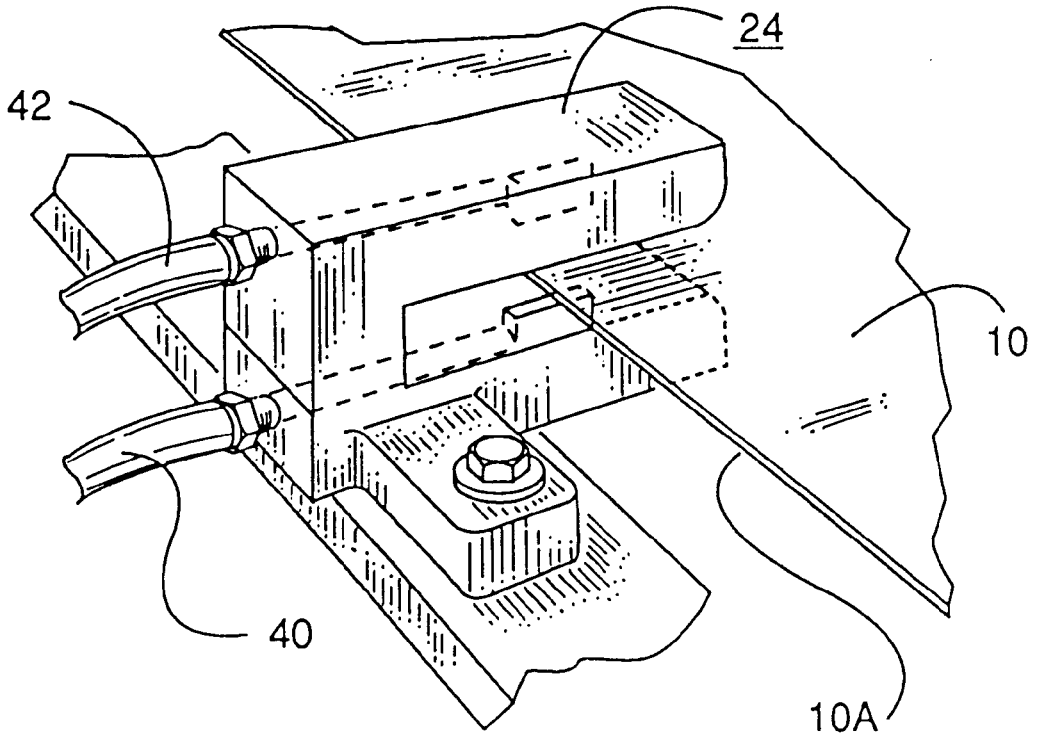
FIG. 10 is a perspective view of the sensor of FIG. 9.

Air supply to the sensor 24 is accomplished by flow in passageway 82 being regulated by variable restricting valve 92 through passageway 93 through conduit 40 to one side of the sensor 24 through a orifice and across web edge 10A. Also, in inlet passageway 82 is a fixed orifice 94, which supplies air simultaneously to the diaphragm cavity 96 and through conduit 42 to the opposite side of the sensor 24, and to an orifice directly opposing the other sensor orifice and outward to the web edge, and atmosphere (FIGS. 9 and 10). Movement of the diaphragm is generated from a signal at the sensor when web moves laterally from a null position. Essentially, valve 22 is in a null position when web edge 10A is not moving laterally at sensor and spool lands 132 and 134 are balanced over exhaust orifices 74 and 76 of the valve.

FIGS. 9 and 10, Sensor 24 generates a signal force by air recovery from the nozzle pressure 40 across the web edge 10A to the low pressure (Signal Pressure) side of the sensor 24. Air is partially being blocked by web edge 10A when spool 72 of the servo valve 22 is in a null position.

Supply air through connecting port 84 that is routed through passage 82 of the sensor port plate 46 is simultaneously ported through conduit 86 to two fixed orifices 88 and 90, the restricting effect of these orifices reduces air consumption and communicate with matched ports 98 and 100 of the actuator port plate to two slight recesses 120 and 122 spaced above exhaust orifice 74 and 76 in the valve body 54 to provide quick signal response from the sensor 24 to the actuator means. Air vents through the valve body 54 through ports 78 and 80 to the atmosphere and through sensor to the atmosphere.

The opening and closing of exhaust orifices 74 and 76 provide air flow through connecting ports 98 and 100 to connecting ports 102 and 104 to the conduits 108 and 110 to actuator 20 which forms a wall of air for driving the actuator piston 26 to control web positioning assembly. For example, if the web 10 should move to the right as viewed in FIG. 2, the higher nozzle pressure, at the sensor 24 will be recovered at the lower, signal pressure side 42 of the sensor, moving the diaphragm 106 to the right, driving the spool valve assembly 72 to the right, the spool valve closes over the right exhaust orifice 76 routing air flow through conduit 108 to actuator air chamber 30, driving piston 26 left and air flow from chamber 32 through exhaust orifice 74 to the atmosphere. Piston rod 34 moves the supply roll 12 axially to the left to its original path. As the web 10 approaches its original lateral position, the web edge 10A partially blocks the air flow of conduit 40 and signal pressure causing the diaphragm 106 to move spool valve 72 to the original null position, closing exhaust orifice 74 and 76 with lands 132 and 134 respectively to restrict air from exhausting from the servo valve.

If the web 10 should stray in the opposite direction, that is to the left, as viewed in FIG. 1, sensor 24 engaged with web edge will move the diaphragm to the left, driving the spool valve assembly left to increase the size of exhaust orifice 76 and increase the overlap of the closed orifice 74. This results in a greater pressure in actuator chamber 32 than in actuator chamber 30 so that the piston 26 moves toward the right as viewed in FIGS. 1 and 2 to bring about rightward movement of the web 10 to its original position.

The resistance to movement of spool valve shaft 56 is substantially the same in opposite directions and as a result, the pressures are decreased or modulated in one chamber 30 or 32 to bring about the necessary corrective movement of the actuator 20. As a consequence, control of movement of the web is equal in opposite directions.

Fixed restricting orifices 88 and 90 located in the actuator port plate 48, are sized equally to provide uniform pressure levels in each line 108 and 110, therefore, in the chambers 30 and 32 of the actuator 20 to maintain minimal air supply usage and position of the supply roll 12 in the necessary location to establish the predetermined path of the web.

Once the restricting orifices 88 and 90 are sized to determine the null point at the sensor and reference point of the web, the pressure regulator 38 can be adjusted to select the pressure of the system. By way of example, the pressure regulator 38 could be set at 10 psi when the force required to bring about corrections in the positions of the web path of the web are relatively low and at some higher level, such as 20 psi, for example, when larger corrective force of the actuator 20 is needed. At any system pressure level the corrections made to the path of the web are proportional to the movement of the web from its selective path and are equal in opposite directions.

A web guide system has been provided which relies on a web position sensor which moves a control valve to modulate the exhaust pressure from one chamber or the other of a double-acting actuator which moves in response to the differential pressure to bring about corrective movement to the web with such corrective movement being equal to the amount of the error.

The sensor regulates the diaphragm pressure by providing nozzle pressure recovery across web edge to an opposing lower signal pressure side of the sensor. These pressures are supplied by the same pressure source as the control pressure side of the servo valve, variable restricting valve 92 provides an adjustable supply pressure to the nozzle, high pressure, side of the sensor 24 and which also communicates with passageway 82 having a flow restricting orifice 94 that communicates with conduit 42 that connects to the signal side of the sensor, providing a low pressure signal, providing a response pressure to the diaphram cavity 96 and servo valve diaphragm to bring about corrective means to a double-acting actuator. Both sensor and servo valve, as well as actuator, use an interconnected air source without the need of any electrically or hydraulically controlled components.

There are several important design features of the servo valve, the valve spool 72 having lands 132 and 134 which are suspended a minute clearance less than the circular inner wall 112, of the valve body 54, while providing a fairly good seal for air flow at the same time provides free movement of the valve shaft 56 and spool 72 assembly from a signal force impinged on the diaphram. The only friction generated is by two valve shaft support bearings 60 and 62 of narrow width, made of low friction material for ease of movement. The valve ports 78 and 80 are mounted in a downward position to expel oil or water that may come into the valve with the air supply. The valve is highly responsive to the low signal pressure impinged on the diaphram, requiring only about +/−0.002 inch web 10 movement from a null position to cause modulation of the valve. Also, low signal pressure at the sensor enables detection and control of very light webs, such as plastic films and textile material.

The unique, simple design of the port plate and valve assembly enables minimal air consumption with a high degree of performance, fixed orifices 88 and 90 throttle air supply to valve exhaust vent orifices 74 and 76, which are blocked by the valve spool lands 132 and 134 when in a null position. When valve orifice is open air exhaust from one side through one of two valve ports. The closed exhaust orifice directs supply pressure to the actuator means. Total air consumption for sensor and control side of servo valve is about 2 cfm at pressures between 10 and 30 psi at regulator.

Due to the simplicity of design of the invention, cost is greatly reduced over other more costly web guide systems. Two of the four basic components are drilled through from one end. Actuator port plate 48 is plugged at one end 118. This plug can be removed if required. Valve is easily assembled in minimal time.

A web guide system has been provided which relies on a web position sensor providing a flow of air which is in direct contact with the edge of a web to directly move a control valve to modulate the exhaust pressure from one chamber or the other of a double-acting actuator which moves in response to the differential pressure to bring about corrective movement to the web with such corrective movement being equal to the amount of error. The only components required are a servo valve, sensor and a double-acting actuator and a source of air pressure interconnected by air lines without the need of any electrically or hydraulically controlled components or servo mechanisms.

Although the servo valve has been described for use with a double acting actuator means, a single acting actuator with a spring return could be substituted.

Although the invention has been described as having a single supply of air 18, two independent sources of air could be used, namely a source for the pneumatic actuator 20 and a source of air for the sensor 24.

Although the valve has been described for use with air, other gasses and liquids could also be used.

I claim:

1. A pneumatic servo valve, comprising a) a body;

b) first and second air passages located in the body, the first and second air passages respectively communicate with first and second outlet ports, the first and second air passages being structured and arranged to be connected to a supply of air;

c) a diaphragm mounted for movement within a chamber of the body, the diaphragm having two sides, one side of the diaphragm communicating with a signal port in the body;

d) a shaft coupled to the other side of the diaphram, the shaft being supported for movement along a length of the shaft and within a cavity, the first and second air passages communicating with the cavity by respective first and second exhaust orifices, the first and second exhaust orifices being spaced apart from each other;

e) a valve coupled to the shaft and located in the cavity, the valve being movable from a null position to first and second positions, wherein when the valve is in the null position, the first and second exhaust orifice are closed, when the valve is in the first position, the first exhaust orifices communicates with an exterior of the body and when the valve is in the second position, the second exhaust orifice communicates with the exterior of the body.

2. The servo valve of claim 1 wherein the first and second air passages communicate with the supply of air via fixed orifices.

3. The servo valve of claim 1 wherein the valve comprises a spool, and the spool is in the cavity.

4. The servo valve of claim 3 wherein the spool has lands, and the cavity is slightly larger than the lands.

5. The servo valve of claim 1 wherein the first and second air passages communicate with the respective first and second exhaust orifices by respective first and second recesses.

6. The servo valve of claim 1 wherein the first and second exhaust orifices are oriented so that liquid drains out when the first and second exhaust orifices are opened.

7. The servo valve of claim 1 wherein the shaft is supported in the cavity by bearings.

8. The servo valve of claim 1, wherein:

a) the valve comprises a spool;

b) the spool has lands, and the cavity is slightly larger than the lands;

c) the first and second air passages communicate with the respective first and second exhaust orifices by respective first and second recesses;

d) the first and second recess orifices are oriented so that liquid drains out when the first and second exhaust orifices are opened;

e) the shaft is supported in the cavity by bearings.

9. An apparatus for controlling the position of an edge of a web of material, comprising:

a) a pneumatic source;

b) a pneumatic sensor located adjacent to the web edge, the sensor having a first side connected to the pneumatic source and a second side connected to a signal conduit, the first and second sides being located on opposite sides of the web;

c) a double acting actuator operatively connected to a web positioner to move the web edge, the actuator having first and second inputs;

d) a servo valve comprising;

i) a body;

ii) first and second air passages located in the body, the first and second air passages respectively communicate with the first and second sides of the actuator, the first and second air passages being connected to the pneumatic source;

iii) a diaphram mounted for movement within a chamber of the body, the diaphram having two sides, one side of the diaphram communicating with the signal conduit of the sensor;

iv) a shaft coupled to the other side of the diaphram, the shaft being supported for the movement along a length of the shaft and within a cavity, the first and second air passages communicating with the cavity by respective first and second exhaust orifices, the first and second exhaust orifices being spaced apart from each other;

v) a valve coupled to the shaft and located in the cavity, the valve being moveable from a null position to first and second positions wherein when the valve is in the null position, the first and second exhaust orifices are closed, when the valve is in the first position, the first exhaust orifice communicates with an exterior of the body and when the valve is in the second position, the second exhaust orifice communicates with the exterior of the body.

* * * * *